US012295495B2

(12) United States Patent
Xu

(10) Patent No.: US 12,295,495 B2
(45) Date of Patent: May 13, 2025

(54) MULTI-PURPOSE FOLDING FRAME AND MULTI-PURPOSE FOLDING FRAME MODULE

(71) Applicant: Guangdong Anti Enterprises Co., Ltd, Dongguan (CN)

(72) Inventor: Dahai Xu, Dongguan (CN)

(73) Assignee: Guangdong Anti Enterprises Co., Ltd, Dongguan (CN)

( * ) Notice: Subject to any disclaimer, the term of this patent is extended or adjusted under 35 U.S.C. 154(b) by 281 days.

(21) Appl. No.: 18/152,746

(22) Filed: Jan. 10, 2023

(65) Prior Publication Data

US 2024/0206628 A1 Jun. 27, 2024

(30) Foreign Application Priority Data

Dec. 21, 2022 (CN) ..... 202223436790.7

(51) Int. Cl.
*A47C 17/70* (2006.01)
*A47B 3/091* (2006.01)

(52) U.S. Cl.
CPC ..... *A47C 17/70* (2013.01); *A47B 3/0912* (2013.01)

(58) Field of Classification Search
CPC ... A47B 3/0912; A47B 3/08; A47B 2003/025; A47C 17/70
See application file for complete search history.

(56) References Cited

U.S. PATENT DOCUMENTS

| | | | | |
|---|---|---|---|---|
| 1,335,456 | A * | 3/1920 | Nelson | A47C 17/64 5/113 |
| 9,131,778 | B2 * | 9/2015 | Jin | A47C 17/72 |
| 11,517,105 | B1 * | 12/2022 | Olsen | A47B 3/00 |
| 2019/0167009 | A1 * | 6/2019 | Huang | A47C 19/14 |
| 2020/0391372 | A1 * | 12/2020 | Strempke | B25H 3/006 |
| 2023/0263310 | A1 * | 8/2023 | Shaw | A47C 17/72 5/114 |

* cited by examiner

*Primary Examiner* — Daniel J Rohrhoff

(57) ABSTRACT

A multi-purpose folding frame and a multi-purpose folding frame module are disclosed. The multi-purpose folding frame comprises a surface board and two leg frames installed on the two ends of the bottom surface of the surface board, which can be folded in relation to the surface board for convenient storage. The bottom end surface of the surface board is configured with a support lock frame. The support lock frame and the hinge rod hinged on the lower end surface of the surface board are fixed on the support lock bar on the tip end of the hinge rod. The inner side of the leg frame is configured with a lock seat. The lock seat is configured with a lock groove.

14 Claims, 15 Drawing Sheets

MULTI-PURPOSE FOLDING FRAME AND MULTI-PURPOSE FOLDING FRAME MODULE

BACKGROUND OF INVENTION

Field of the Invention

The present invention relates generally to a multi-purpose folding frame and a multi-purpose folding frame module.

Description of Related Art

A folding frame is a frame that can be folded to reduce its size for convenient storage. As it is very convenient to use, it is popular among consumers. Moreover, the folding frame can be applied in various daily-use products, such as stools, chairs, tables, and beds to form folding stools, folding chairs, folding tables, folding beds, etc.

China Patent No. ZL202020112379.6 disclosed a folding bed frame and a combination-type bed frame. The folding bed frame comprises two folding bed frame comprises two bed surface boards hinged together, leg frames and connecting pieces. One end of each connecting piece is hinged with the bed surface board, the other end of the connecting piece is fixed on the leg frame, and the leg frame can move between the open position and the folded position; the connecting piece is configured with a limiting portion. When the leg frame is at the open position, the limiting portion can coordinate with the bed surface board to prevent the leg frame from shaking or folding inversely.

To support the bed surface board, the leg frames of the above folding bed frame must be open in relation to the bed surface board for an angle larger than 90°. However, there is no mechanism to assist the supporting or locking. As a result, the folding bed frame is not supported stably and will shake easily. When the leg frame swings and the bed surface board is folded, the bed surface board loses the support of the leg frame and collapses. This is obviously not safe to use.

In view of this, the following technical solution is proposed to solve the above technical problem.

SUMMARY OF THE INVENTION

The purpose of the present invention is to overcome the shortcomings of the prior art and provide a multi-purpose folding frame and a multi-purpose folding frame module.

In order to solve the problems of the technologies described above, the present invention adopts the following first technical solution:

A multi-purpose folding frame, comprising a surface board, two leg frames installed on both ends of a bottom surface of the surface board and used to support the surface board and capable of being folded and stored relative to the surface board, and a collapsible support lock frame disposed on a lower end surface of the surface board, wherein the support lock frame includes a hinge rod hinged to the lower end surface of the surface board and a support lock bar fixed at an end of the hinge rod; an inner side of each leg frame includes a lock seat, and the lock seat is provided with a lock groove; when the support lock frame is opened relative to the panel, the end of the support lock bar extends into and locks in the lock groove of the lock seat, so that the two ends of the support lock bar respectively support and lock the two leg frames.

More preferably, the lock seat includes a holding slot connected to the lock groove at an entrance of the lock groove, the holding slot is hinged with a freely rotatable stopping block, the stopping block swings down under the action of gravity until a side of the blocking block contacts an inner wall of the holding slot, and the stopping block is blocked at the entrance of the lock groove to prevent the end of the support lock bar from breaking out of the lock groove; when the multi-purpose folding frame is overturned by 90°, the stopping block swings downward under the action of gravity and is accommodated in the holding slot.

More preferably, wherein the lock groove has locking convex ribs; the end portion of the support lock bar is configured with a limiting slot, the limiting slot is sheathed around the locking convex rib, and is tightly fixed and assembled.

More preferably, wherein the leg frame and the bottom surface of the surface board are hinged through a first hinge seat and a first hinge pin, and the first hinge seat is fixed on the bottom surface of the surface board, a first torsion spring is configured between the leg frame and the first hinge seat; after the leg frame is folded in relation to the surface board, the first torsion spring provides an elastic force for the leg frame to be attached to the bottom surface of the surface board.

More preferably, wherein the hinge rod and the bottom surface of the surface board are hinged through a second hinge seat and a second hinge pin, and the second hinge seat is fixed on the bottom surface of the surface board, a second torsion spring is configured between the hinge rod and the second hinge seat; the leg frame is also configured with a tilted storage groove, after the hinge rod is folded in relation to the surface board for storage, the second torsion spring provides an elastic force for the hinge rod to be attached to the bottom surface of the surface board, and the support lock bar is embedded into the storage groove.

In order to solve the problems of the technologies described above, the present invention adopts the following second technical solution:

A multi-purpose folding frame module, comprising two multi-purpose folding frames, wherein the first multi-purpose folding frame and the second multi-purpose folding frame can be folded upward or downward, and a locking structure is configured between the first multi-purpose folding frame and the second multi-purpose folding frame; Specifically, each multi-purpose folding frame comprises a surface board and two leg frames installed on the two ends of the bottom surface of the surface board to support the surface board, which can be folded in relation to the surface board for convenient storage, the lower end surface of the surface board is further configured with a support lock frame that can be folded, the support lock frame and the hinge rod hinged on the lower end surface of the surface board is fixed on the support lock bar on the tip end of the hinge rod; the inner side of the leg frame is configured with a lock seat, the lock seat is configured with a lock groove; after the support lock frame is open in relation to the surface board, the end portion of the support lock bar sticks in and is locked inside the lock groove of the lock seat, so that the two ends of the support lock bar respectively support and lock the two leg frames.

More preferably, wherein the opposite surfaces of the first multi-purpose folding frame and the second multi-purpose folding frame are respectively configured with a third hinge seat and a fourth hinge seat, the third hinge seat and the fourth hinge seat are hinged through a first hinge plate combined with a first hinge shaft and a second hinge shaft, wherein, one end of the first hinge plate is hinged with the third hinge seat through the first hinge shaft; the other end of the first hinge plate is hinged with the fourth hinge seat through the second hinge shaft; thus, the first multi-purpose folding frame and the second multi-purpose folding frame can be folded in relation to each other.

More preferably, wherein the locking structure comprises a locking board and a locking plate configured on the tip end of the locking board, and capable of free rotation, the locking board is hinged on the front end of the third hinge seat, the locking board can be rotated to be held inside the groove on the front end of the fourth hinge seat, and under the force of its own gravity, the locking plate swings downward and is embedded into the lock mouth on the lower end of the groove, so that the tip end of the locking board is locked inside the groove of the front end of the fourth hinge seat.

More preferably, wherein the outer side of the locking plate is further configured with a lug to facilitate operation.

More preferably, wherein the outer side of the first multi-purpose folding frame is further hinged with a third multi-purpose folding frame, the folding direction between the first multi-purpose folding frame and the third multi-purpose folding frame is opposite to the folding direction between the first multi-purpose folding frame and the second multi-purpose folding frame; the outer side of the second multi-purpose folding frame is further hinged with a fourth multi-purpose folding frame, the folding direction between the second multi-purpose folding frame and the fourth multi-purpose folding frame is opposite to the folding direction between the first multi-purpose folding frame and the second multi-purpose folding frame, the first multi-purpose folding frame, the second multi-purpose folding frame, the third multi-purpose folding frame, and the fourth multi-purpose folding frame can be folded together; each multi-purpose folding frame is configured with an inserting seat, and the inserting seat has an inserting hole for the supporting tube to insert in.

More preferably, wherein the lock seat is configured with a holding slot at the entrance of the lock groove, which is communicated with the lock groove, the holding slot is hinged with a stopping block that can rotate freely, under the force of its own gravity, the stopping block swings downward to its lateral side to contact the inner wall of the holding slot, the stopping block blocks the entrance of the lock groove to prevent the end portion of support lock bar from falling off the lock groove (210); when the multi-purpose folding frame is turned for 90°, under the force of its own gravity, the stopping block swings downward and is held inside the holding slot.

More preferably, wherein the lock groove has locking convex ribs; the end portion of the support lock bar is configured with a limiting slot, the limiting slot is sheathed around the locking convex ribs and is tightly fixed and assembled.

More preferably, wherein the leg frame and the bottom surface of the surface board are hinged through a first hinge seat combined with a first hinge pin, and the first hinge seat is fixed on the bottom surface of the surface board, a first torsion spring is configured between the leg frame and the first hinge seat; after the leg frame is folded in relation to the surface board for storage, the first torsion spring provides an elastic force for the leg frame to be attached to the bottom surface of the surface board.

More preferably, wherein the hinge rod and the bottom surface of the surface board are hinged through a second hinge seat combined with a second hinge pin, and the second hinge seat is fixed on the bottom surface of the surface board, a second torsion spring is configured between the hinge rod and the second hinge seat; the leg frame is configured with a tilted storage groove, after the hinge rod is folded in relation to the surface board for storage, the second torsion spring provides an elastic force for the hinge rod to be attached to the bottom surface of the surface board, and the support lock bar is embedded into the storage groove.

Comparing with the prior art, the present invention has the following advantages and benefits:

1. During the use of the present invention, the two leg frames are open outward in relation to the surface board to support the surface board. Thus, it can be used as a folding stool, a folding table, a folding bed etc to realize multi-purpose usage. The folding stool, folding table and folding bed are different only in size. When they are not used, they can be folded by folding the two leg frames in relation to the surface board to save area/space for storage and transportation. It is very convenient.
2. The multi-purpose folding frame of the invention is additionally configured with support lock frames and lock seats. When the multi-purpose folding frame is open for use, the two leg frames are open outward in relation to the surface board, and the support lock frame can be open in relation to the surface board. Now, the tip end of the support lock bar of the support lock frame sticks into the lock groove of the lock seat and is locked inside, so that the two ends of the support lock bar respectively support and lock the two leg frames to prevent the two leg frames from folding accidentally. In this way, the two leg frames can stably support the surface board to maintain the structure and avoid shaking of the multi-purpose folding frame. Even if the multi-purpose folding frame is pushed, the two leg frames will not be folded accidentally to cause collapse. Therefore, it is safer to use.

DETAILED DESCRIPTION OF THE INVENTION

Figure 1:
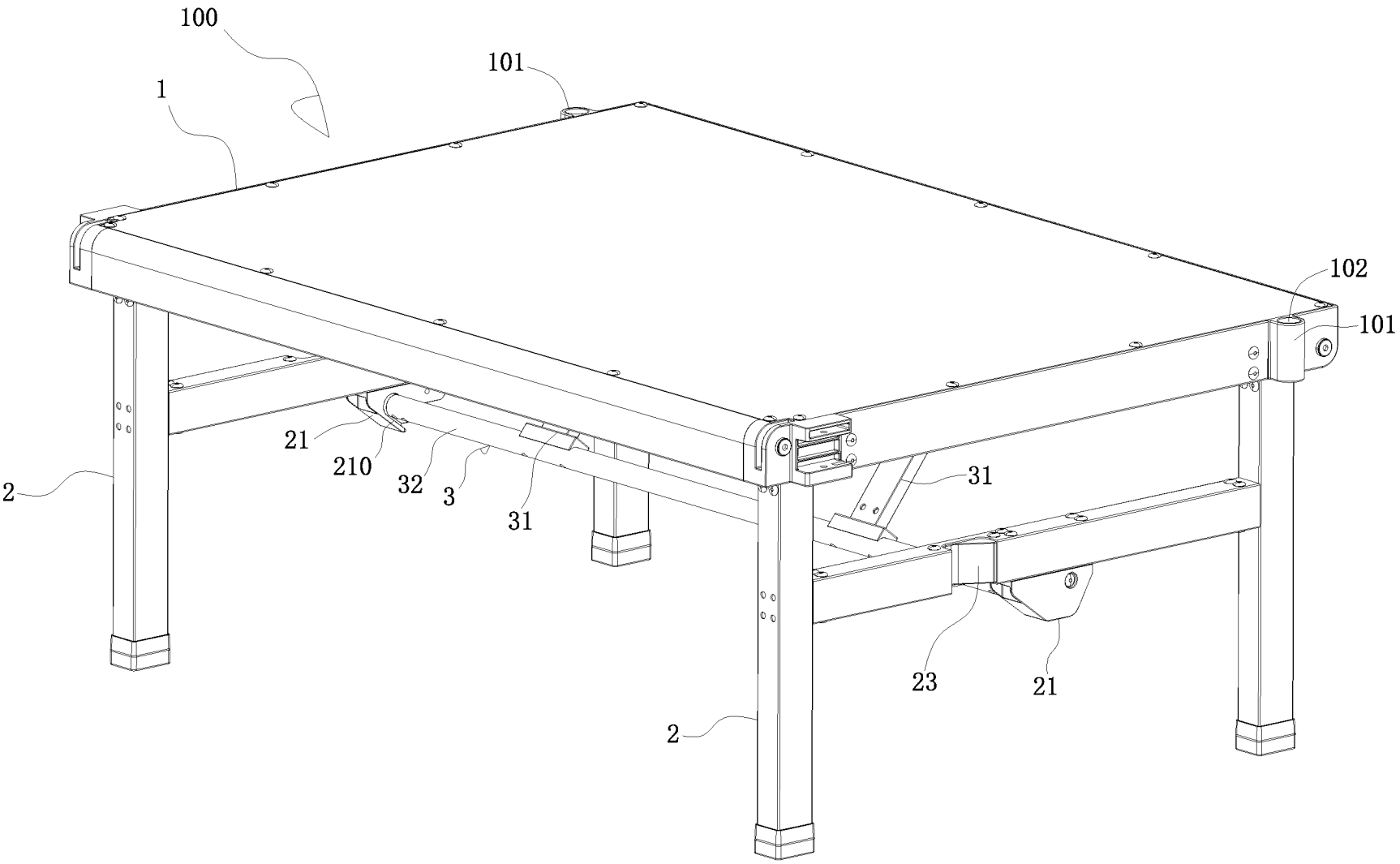
FIG. 1 is a perspective view of the multi-purpose folding frame of the invention from the first viewing angle.
Figure 2:
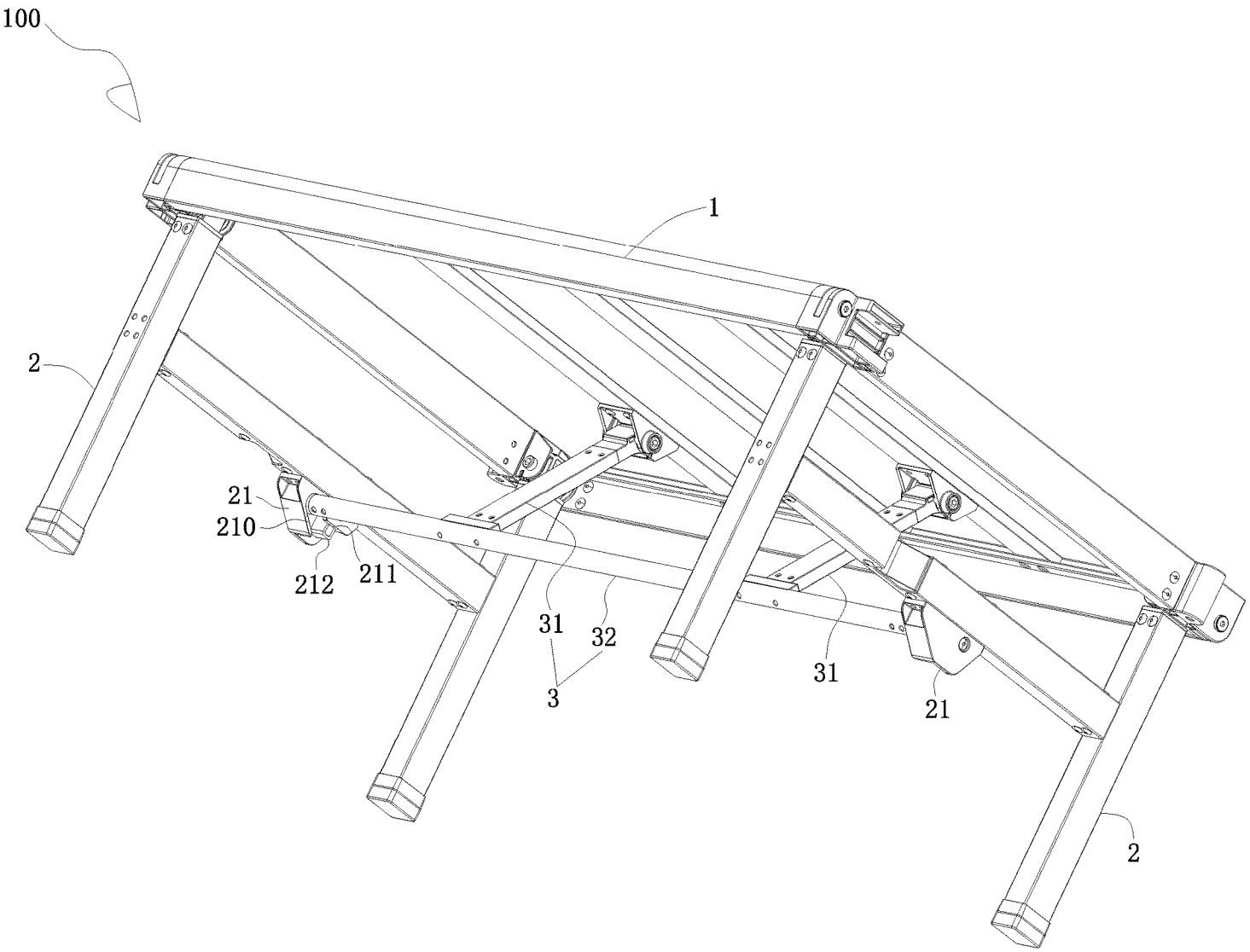
FIG. 2 is a perspective view of the multi-purpose folding frame of the invention from the second viewing angle.

Referring to FIGS. 1-5, 15, the multi-purpose folding frame 100 comprises a surface board 1 and two leg frame 2 installed on the two ends of the bottom surface of the surface board 1 to support the surface board 1 and capable of folding in relation to the surface board 1 for convenient storage. When it is used, the two leg frames 2 are open outward in relation to the surface board 1 to support the surface board 1. Thus, it can be used as a folding stool, a folding table or a folding bed for multi-purpose usage. The folding stool, folding table, and folding bed are different only in size. When they are not used, the two leg frames 2 can be folded in relation to the surface board 1. As the occupied area/space is reduced, storage or transportation becomes very convenient. The following is an implementation using one single multi-purpose folding frame as a folding table.

The leg frame 2 is in the shape of H. Of course, it can also be in other shapes.

Referring to FIGS. 1-5, the lower end surface of the surface board 1 is further configured with a support lock frame 3 that can be folded. The support lock frame 3 and the hinge rod 31 hinged on the lower end surface of the surface board 1 are fixed on the support lock bar 32 at the tip end of the hinge rod 31; the inner side of the leg frame 2 is configured with a lock seat 21. The lock seat 21 is configured with a lock groove 210; after the support lock frame 3 is open in relation to the surface board 1, the end portion of the support lock bar 32 sticks into the lock groove 210 of the lock seat 21 and is locked inside, so that the two ends of the support lock bar 32 respectively support and lock the two leg frames 2. The multi-purpose folding frame of the invention is additionally configured with a support lock frame 3 and a lock seat 21. When the multi-purpose folding frame is open for use, after the two leg frames 2 are open in relation to the surface board 1, the support lock frame 3 is open in relation to the surface board 1. Now, the end portion of the support lock bar 32 of the support lock frame 3 sticks into the lock groove 210 of the lock seat 21 and is locked inside, so that the two ends of the support lock bar 32 respectively support and lock the two leg frames 2 to prevent the two leg frames 2 from folding accidentally. Thus, the two leg frames 2 can stably support the surface board to maintain a stable structure, avoiding shaking of the multi-purpose folding frame. Even if the multi-purpose folding frame is pushed, the two leg frames 2 will not be folded accidentally to cause collapse. Therefore, it is safer to use.

In the support lock frame 3, there can be only one hinge rod 31 or two hinge rods 31 installed as required. Specifically, one end of each hinge rod 31 is hinged with the lower end face of the surface board 1, and the other end is fixed with the support lock bar 32.

Figure 4:
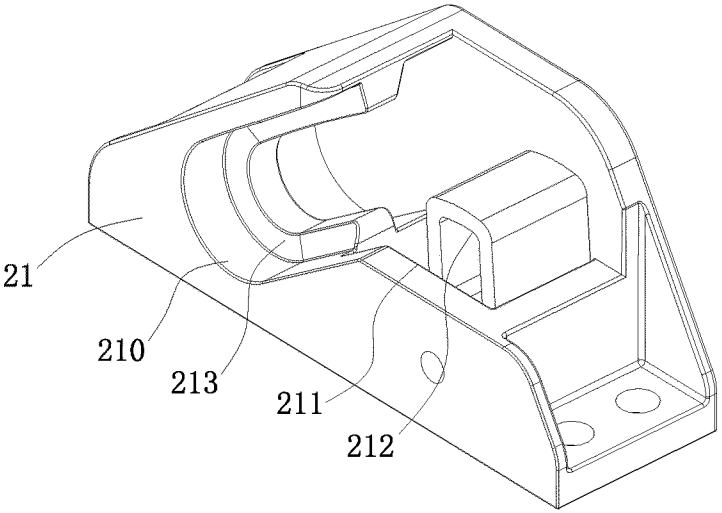
FIG. 4 is a variation diagram of the usage state of the lock seat of the invention.
Figure 4:
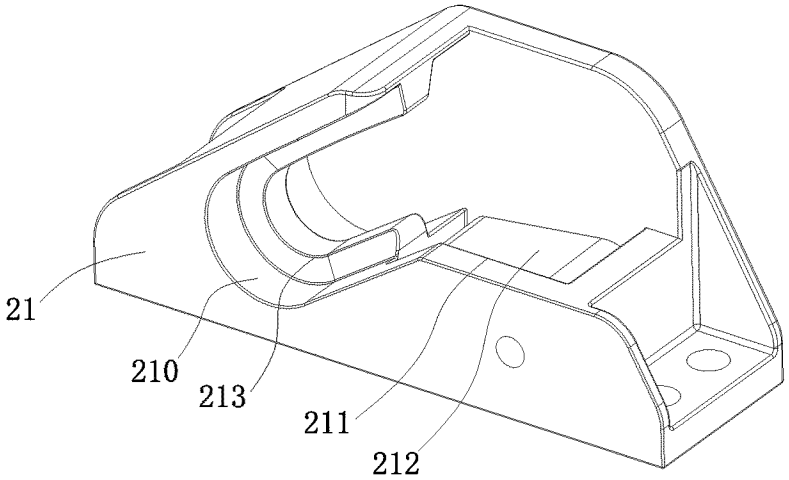

Referring to FIG. 4, the lock groove 210 is designed in a tilted manner. In this way, after the support lock bar 32 swings, the end portion of the support lock bar 32 can smoothly go into the lock groove 210.

Figure 3:
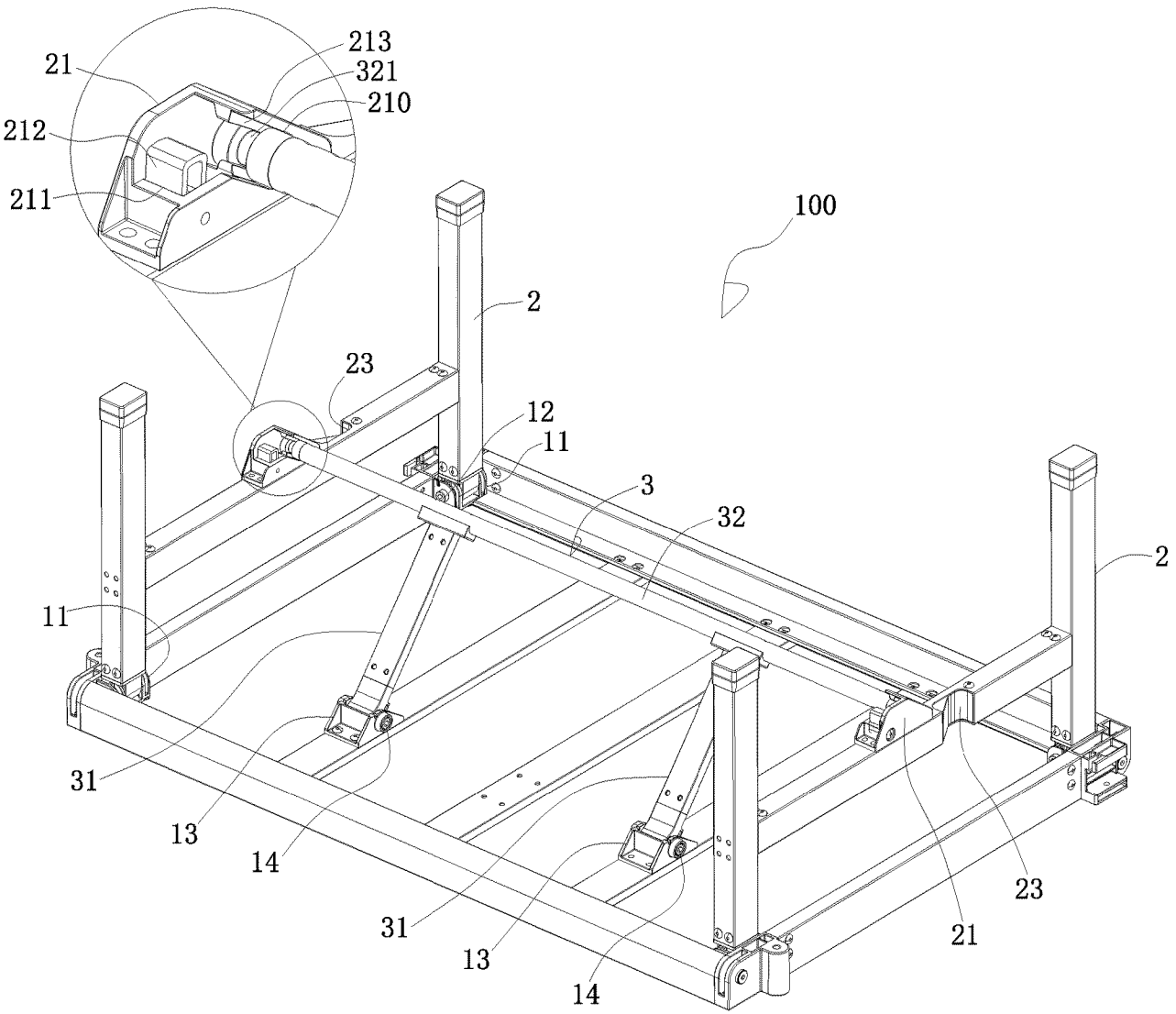
FIG. 3 is a perspective view of the multi-purpose folding frame of the invention from the third viewing angle.
Figure 5:
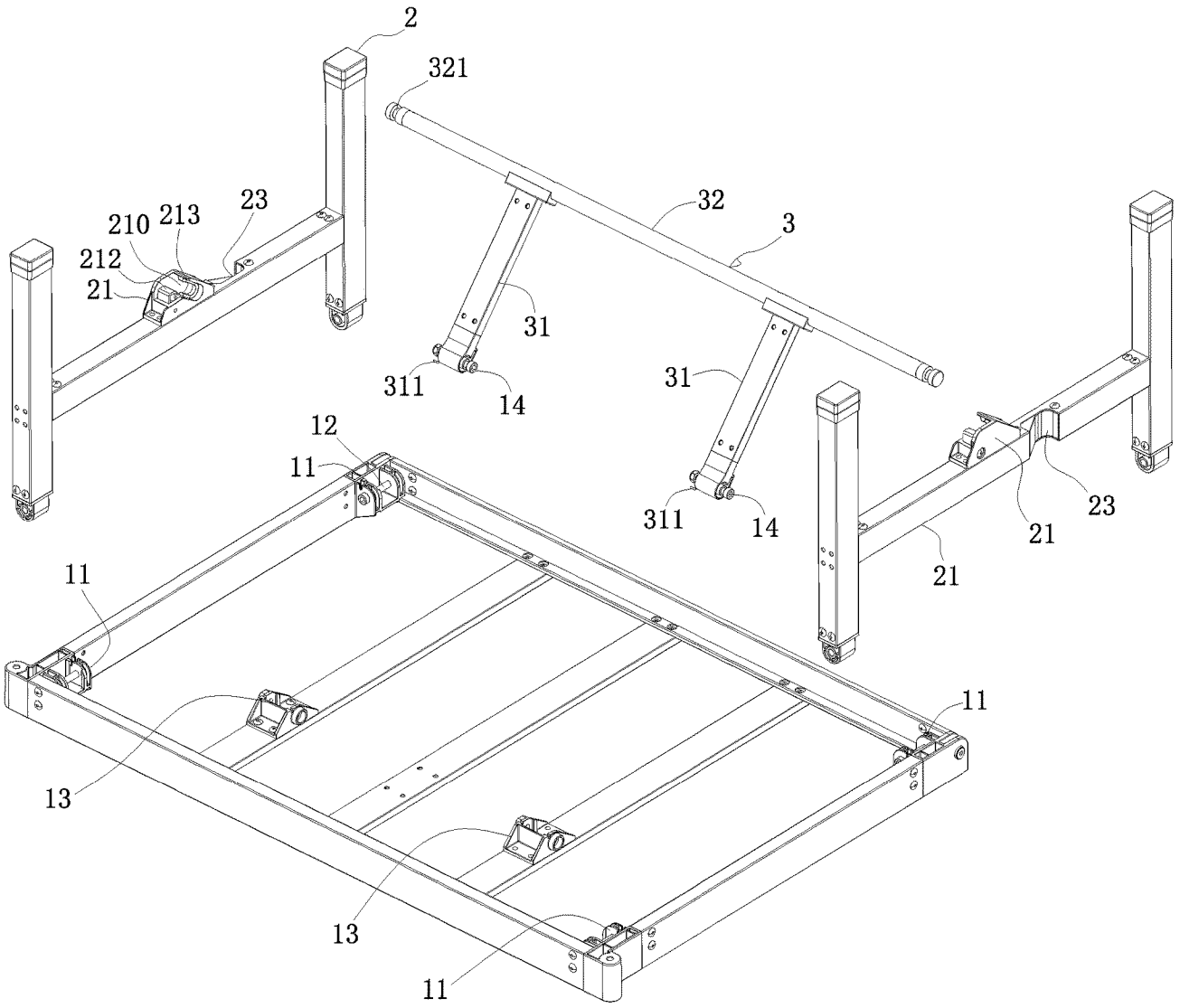
FIG. 5 is an exploded perspective view of the multi-purpose folding frame of the invention.
Figure 6:
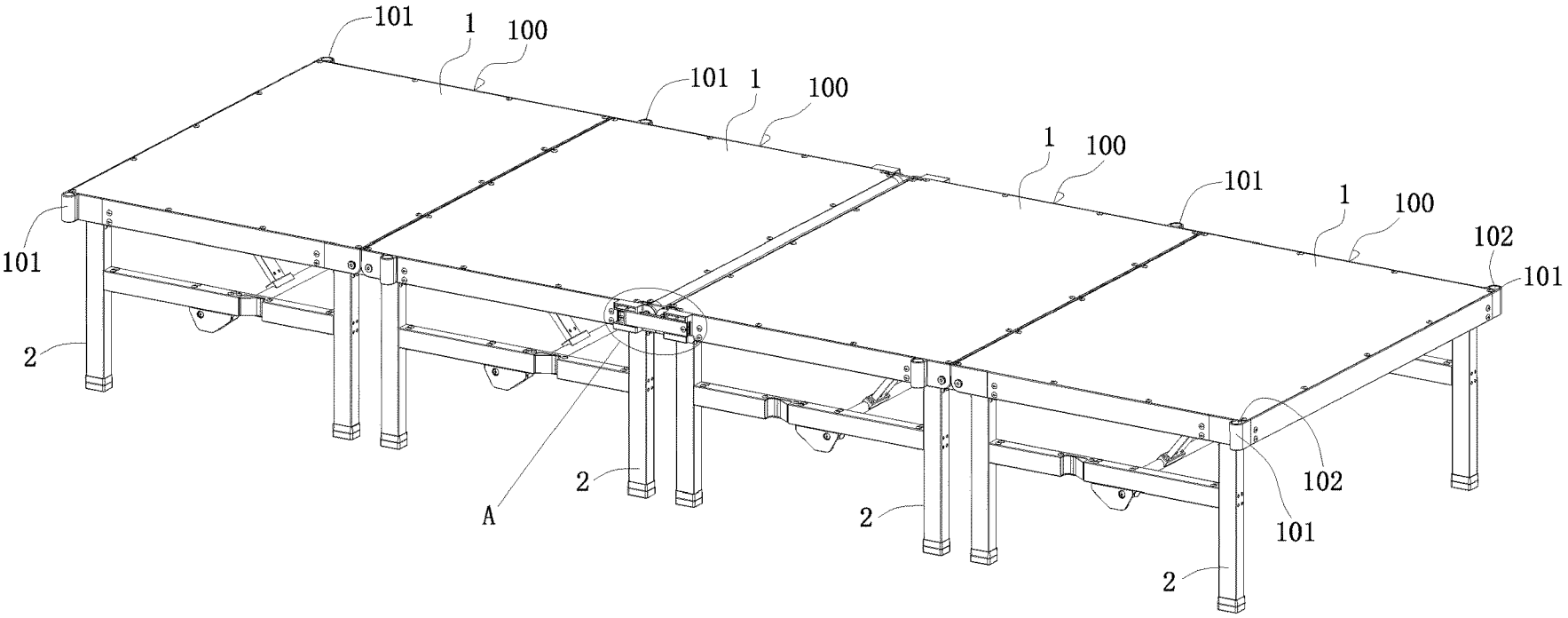
FIG. 6 is a perspective view of the multi-purpose folding frame module of the invention.
Figure 7:
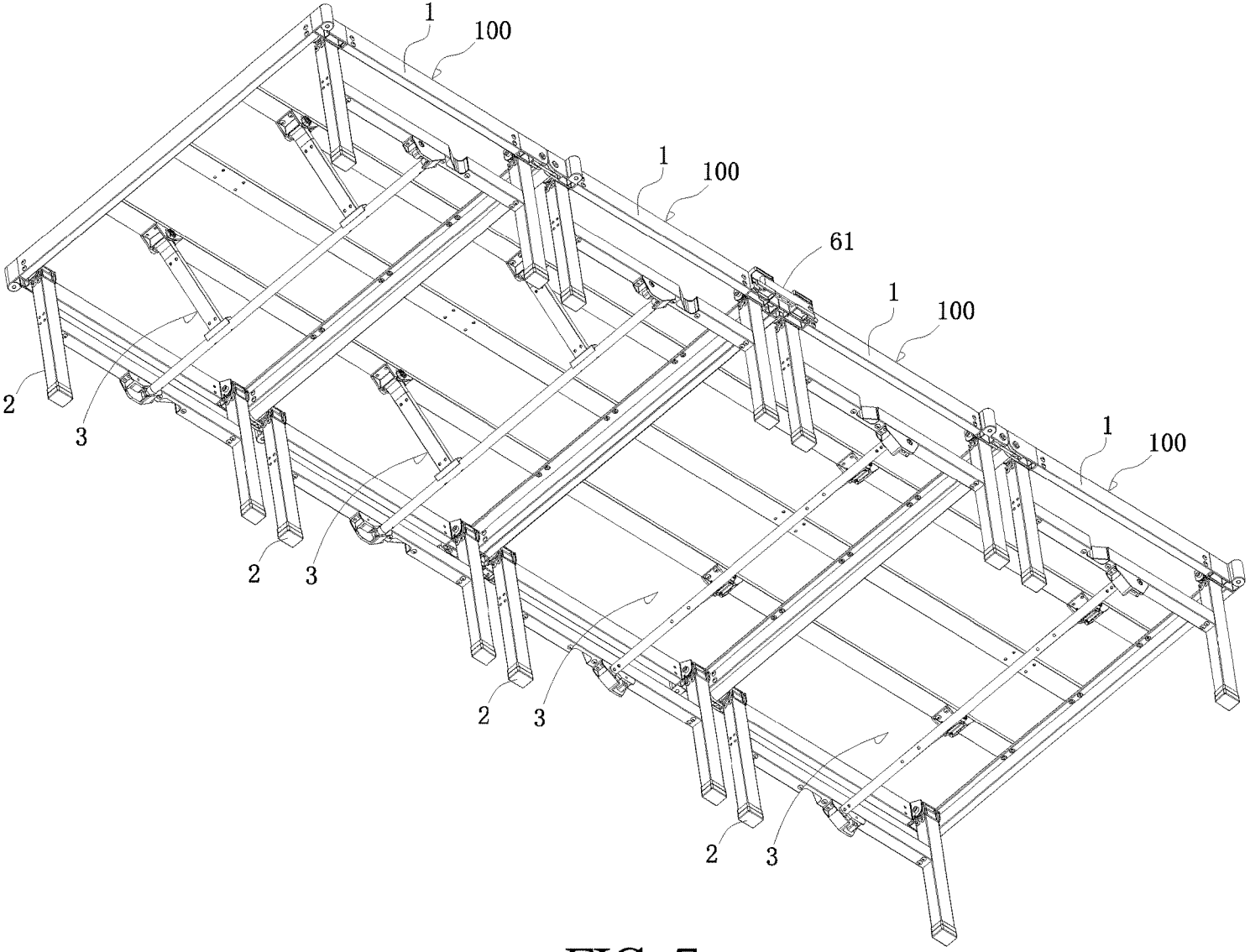
FIG. 7 is a perspective view of the multi-purpose folding frame module of the invention from another viewing angle.
Figure 8:
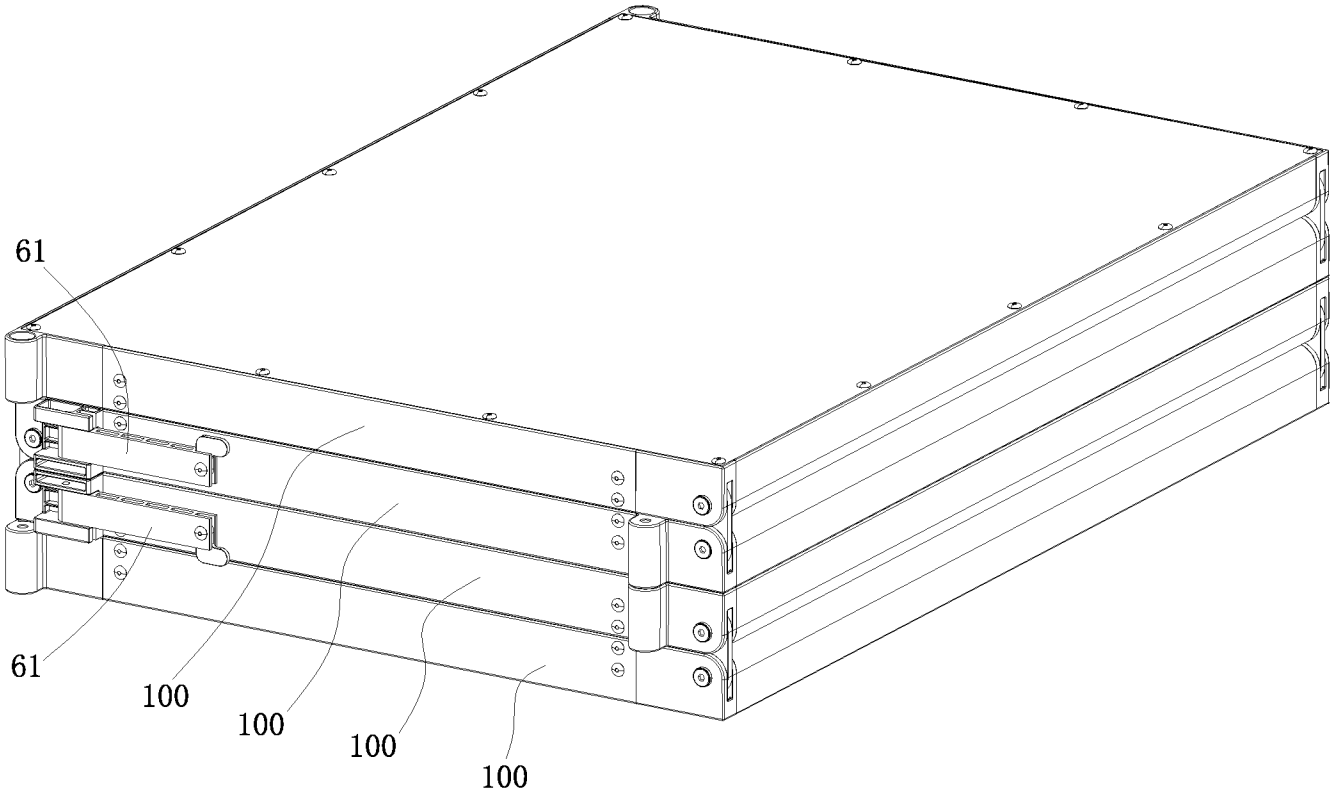
FIG. 8 is a perspective view of the multi-purpose folding frame module of the invention after folding.
Figure 9:
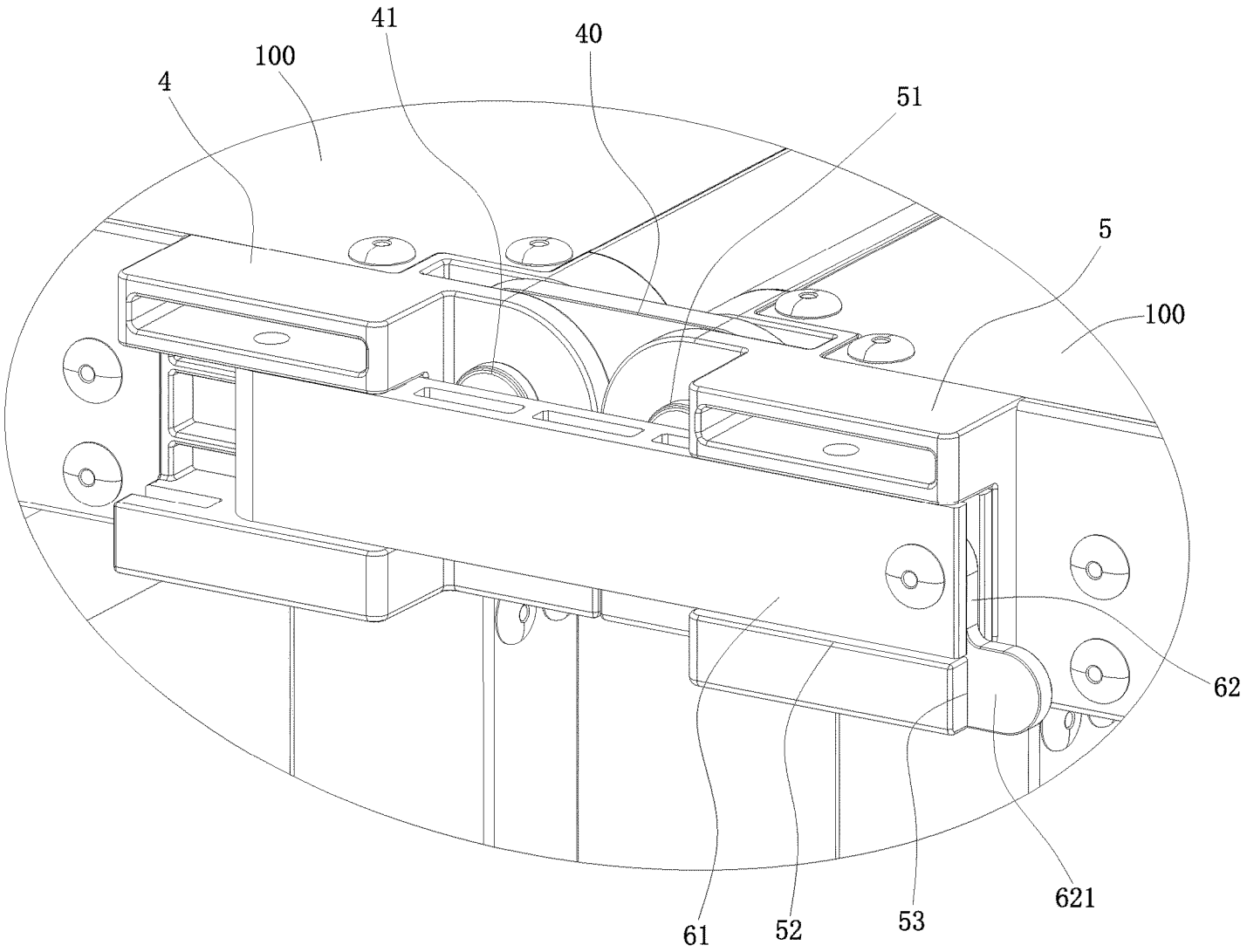
FIG. 9 is a partially enlarged view of Part A in FIG. 6.
Figure 10:
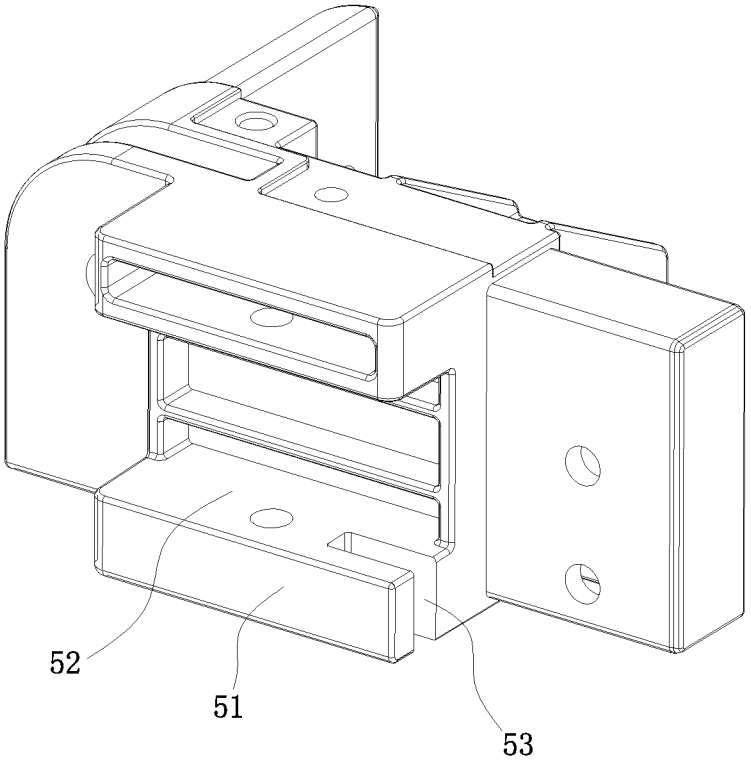
FIG. 10 is a perspective view of the third hinge seat of the invention.
Figure 11:
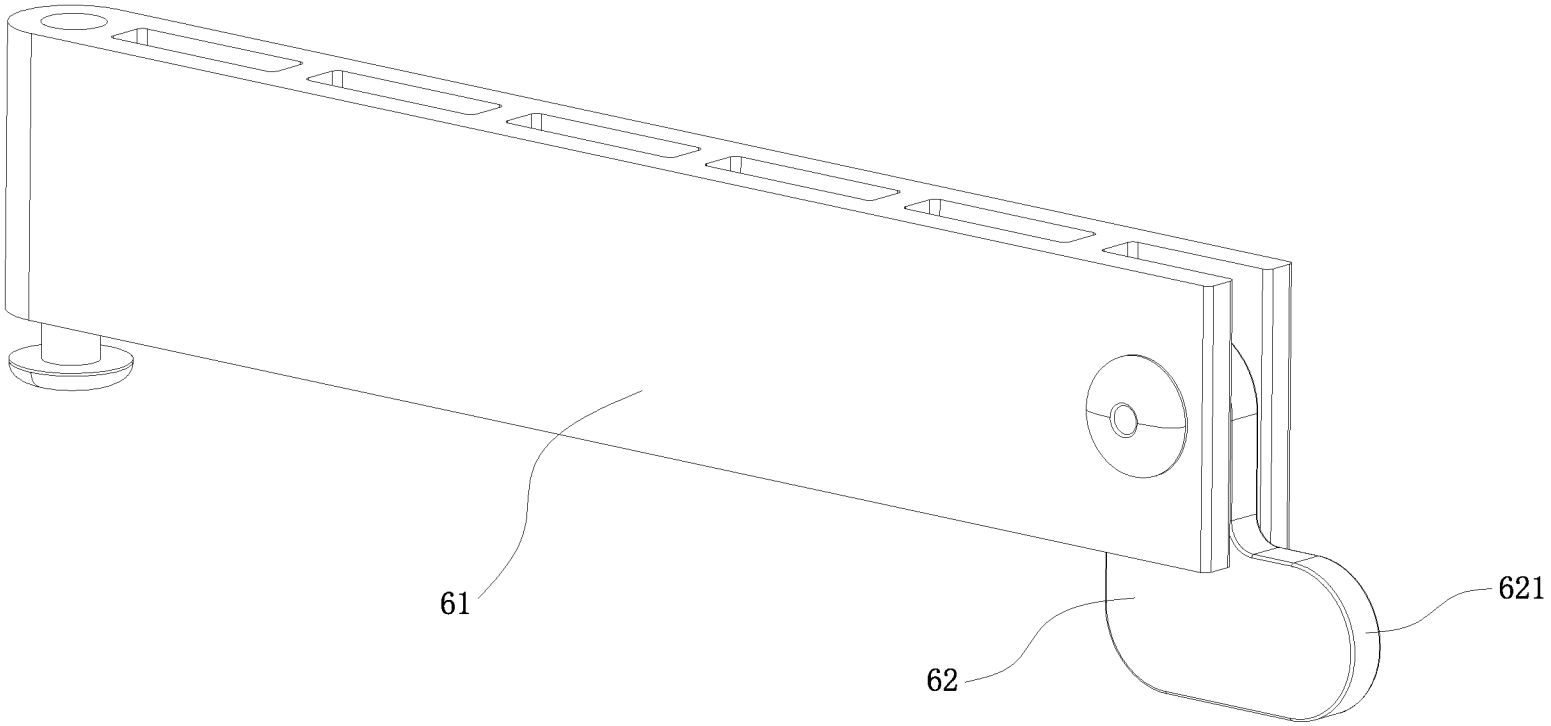
FIG. 11 is a perspective view of the locking board of the invention.

Referring to FIGS. 3-5, the lock groove 210 has locking convex ribs 213 held inside; the end portion of the support lock bar 32 is configured with a limiting slot 321. The limiting slot 321 is sheathed outside the locking convex ribs 213, and is tightly fixed and assembled. Thus, when the end portion of the support lock bar 32 is installed inside the lock groove 210, the end portion of the support lock bar 32 and the lock groove 210 can be locked together.

In order to enhance the structural stability of the multi-purpose folding frame, the following design is provided: Referring to FIGS. 3-4, at the entrance of the lock groove 210, the lock seat 21 is configured with a holding slot 211 that is communicated with the lock groove 210. The holding slot 211 is hinged with a stopping block 212 that can rotate freely. Under the force of its own gravity, the stopping block 212 swings downward to its lateral side to contact with the inner wall of the holding slot 211. Now, the stopping block 212 blocks the entrance of the lock groove 210 to prevent the end portion of the support lock bar 32 from falling off the lock groove 210. Thus, the support lock frame 3 will not be accidentally folded in relation to the surface board 1. This can effectively ensure the structural stability of the multi-purpose folding frame, and the product can be used more safely. Moreover, the stopping block 212 features simple design, low cost, easy operation and convenient use. When it is needed to fold the multi-purpose folding frame, turn the multi-purpose folding frame for 90°, i.e., the surface board 1 faces downward and the leg frame 2 faces upward. Now, under the force of its own gravity, the stopping block 212 will swing downward and be held inside the holding slot 211, i.e., the stopping block 212 will not block the entrance of the lock groove 210. Now, the end portion of the support lock bar 32 can be easily released from the lock groove 210. The operation is very easy. Meanwhile, as the two leg frames 2 are unlocked, the two leg frames 2 can be folded and stored conveniently. Other structures can be used to limit the end portion of the support lock bar 32 to prevent the support lock bar 32 from accidentally falling off the lock groove 210. For example, the lock seat 21 is configured with a pin. The pin partly blocks the entrance of the lock groove 210 to prevent the end portion of the support lock bar 32 from falling off the lock groove 210.

The leg frame 2 and the bottom surface of the surface board 1 are hinged through a first hinge seat 11 in combination with a first hinge pin 12, and the first hinge seat 11 is fixed on the bottom surface of the surface board 1. A first torsion spring is configured between the leg frame 2 and the first hinge seat 11. Such a design has the following advantage: after the leg frame 2 is folded in relation to the surface board 1 for storage, the first torsion spring provides an elastic force for the leg frame 2 to be attached to the bottom surface of the surface board 1.

Figure 15:
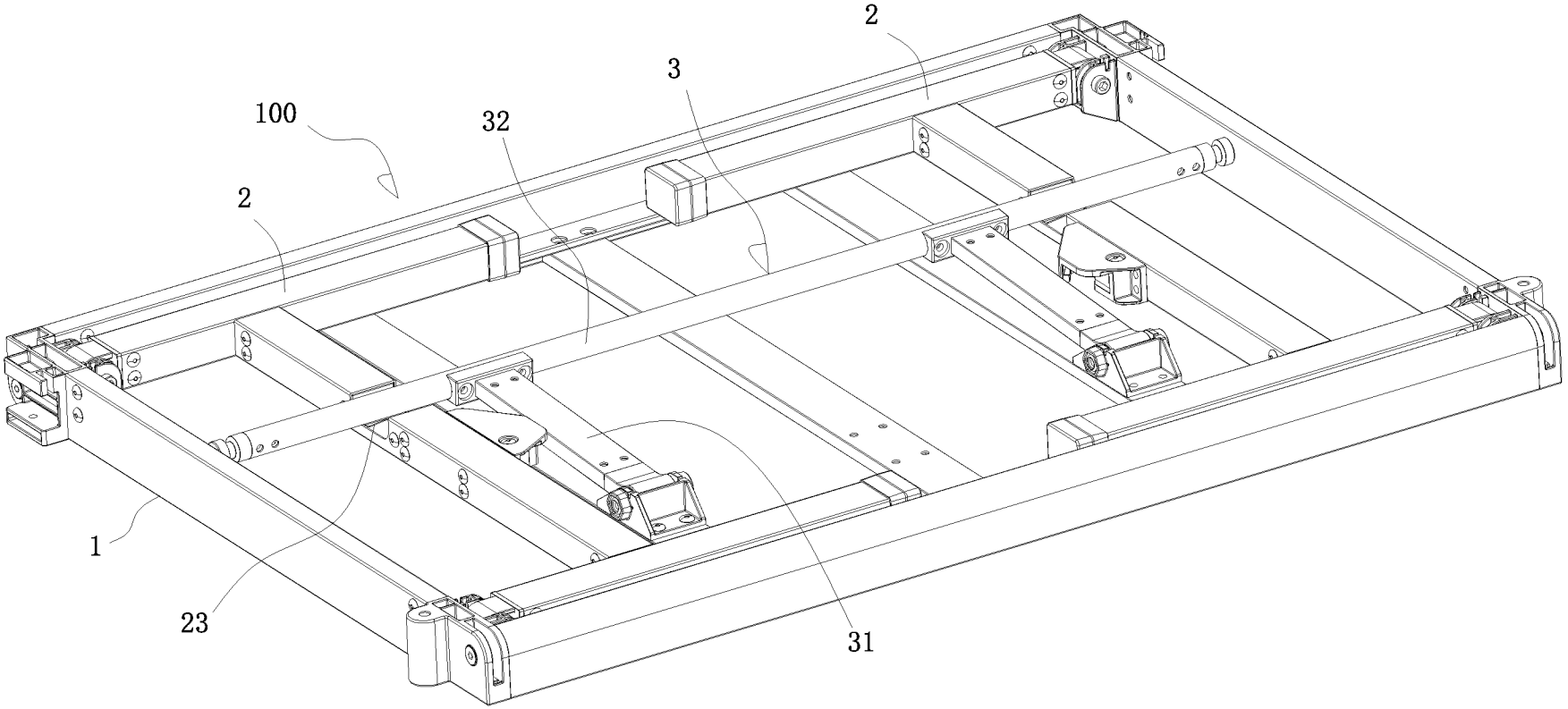
FIG. 15 is a folded state view of the multi-purpose folding frame of the invention.

Referring to FIG. 5, the hinge rod 31 and the bottom surface of the surface board 1 are hinged through a second hinge seat 13 in combination with a second hinge pin 14, and the second hinge seat 13 is fixed on the bottom surface of the surface board 1. Furthermore, a second torsion spring 311 is configured between the hinge rod 31 and the second hinge seat 13. The leg frame 2 is further configured with a tilted storage groove 23. Such a design has the following advantage: after the hinge rod 31 is folded in relation to the surface board 1 for storage, the second torsion spring 311 provides an elastic force for the hinge rod 31 to be attached to the bottom surface of the surface board 1. Meanwhile, the support lock bar 32 is embedded into the storage groove 23, further reducing the height of the product after folding for convenient storage. As the storage groove 23 is designed in a tilted manner, when the hinge rod 31 swings, the hinge rod 31 can smoothly go into the storage groove 23. Referring to FIG. 15, to fold the multi-purpose folding frame, firstly swing the support lock frame 3 to unlock the two leg frames 2, then the two leg frames 2 are folded. The two leg frames 2 are folded onto the bottom surface of the surface board 1. Then, the support lock frame 3 is folded in relation to the surface board 1. The hinge rod 31 of the support lock frame 3 is attached to the bottom surface of the surface board 1, and the support lock bar 32 is embedded into the storage groove 23 to further reduce the height of the product after folding.

To summarize, the multi-purpose folding frame 100 of the invention is additionally configured with a support lock frame 3 and a lock seat 21. When the multi-purpose folding frame is open for use, after the two leg frames 2 are open in relation to the surface board 1, the support lock frame 3 is open in relation to the surface board 1. The end portion of the support lock bar 32 of the support lock frame 3 sticks into the lock groove 210 of the lock seat 21 and is locked inside, so that the two ends of the support lock bar 32 respectively support and lock the two leg frames 2 to avoid accidental folding of the two leg frames 2. Thus, the two leg frames 2 can stably support the surface board, providing a stable structure to avoid shaking of the multi-purpose folding frame. Even if the multi-purpose folding frame is pushed, the two leg frames 2 will not be folded accidentally to cause collapse. Therefore, it can be used safely.

Referring to FIGS. 1-14, the present invention further provides a multi-purpose folding frame module, which at least comprises two multi-purpose folding frames 100 as described above. The multi-purpose folding frame module can be used as a folding table or a folding bed. Specifically, the first multi-purpose folding frame 100 and the second multi-purpose folding frame 100 can be folded upward or downward, and between the first multi-purpose folding frame 100 and the second multi-purpose folding frame 100, a locking structure can be configured. The locking structure can lock the first multi-purpose folding frame 100 and the second multi-purpose folding frame 100 in the open position to ensure a stable structure, preventing the first multi-purpose folding frame 100 and the second multi-purpose folding frame 100 from folding accidentally. Thus, the product can be used more safely and reliably.

The opposite faces of the first multi-purpose folding frame 100 and the second multi-purpose folding frame 100 are configured with a third hinge seat 4 and a fourth hinge seat 5. The third hinge seat 4 and fourth hinge seat 5 are hinged through a first hinge plate 40 in combination with a first hinge shaft 41 and a second hinge shaft 51. Specifically, one end of the first hinge plate 40 is hinged through a first hinge shaft 41 and a third hinge seat 4, whereas the other end of the first hinge plate 40 is hinged through a second hinge shaft 51 and a fourth hinge seat 5, enabling folding of the first multi-purpose folding frame 100 and the second multi-purpose folding frame 100 in relation to each other.

The locking structure comprises a locking board 61 and a locking plate 62 configured on the tip end of the locking board 61 and capable of free rotation. The locking board 61 is hinged on the front end of the third hinge seat 4. The locking board 61 can be rotated and be held inside the groove 52 on the front end of the fourth hinge seat 5. Under the force of its own gravity, the locking plate 62 swings downward and is embedded into the lock mouth 53 on the lower end of the groove 52, so that the tip end of the locking board 61 is locked inside the groove 52 on the front end of the fourth hinge seat 5. After opening the first multi-purpose folding frame 100 and the second multi-purpose folding frame 100 in relation to each other, the upper end surfaces of the first multi-purpose folding frame 100 and the second multi-purpose folding frame 100 are aligned on the same level to form a supporting face. Now, the locking board 61 can be rotated and be held inside the groove 52 on the front end of the fourth hinge seat 5. Under the force of its own gravity, the locking plate 62 will swing downward and be embedded into the lock mouth 53 on the lower end of the groove 52, so that the tip end of the locking board 61 is locked inside the groove 52 on the front end of the fourth hinge seat 5. In this way, the locking is realized. The locking structure is simple and easy to operate. Its cost is also very low. To unlock it, simply move the locking plate 62 upward to release it from the lock mouth 53, and pull the locking board 61 outward. The unlocking operation is also very easy.

The outer side of the locking plate 62 is further configured with a lug 621 to facilitate operation. The lug 621 can be held by the hand of the operator to move the locking plate 62 upward to be released from the lock mouth 53, and then the locking board 61 can be pulled outward to realize unlocking. The operation is very easy.

The outer side of the first multi-purpose folding frame 100 is further hinged with a third multi-purpose folding frame 100. The folding direction between the first multi-purpose folding frame 100 and the third multi-purpose folding frame 100 is opposite to the folding direction between the first multi-purpose folding frame 100 and the second multi-purpose folding frame 100; the outer side of the second multi-purpose folding frame 100 is further hinged with a fourth multi-purpose folding frame 100. The folding direction between the second multi-purpose folding frame 100 and the fourth multi-purpose folding frame 100 is opposite to the folding direction between the first multi-purpose folding frame 100 and the second multi-purpose folding frame 100. In this way, the first multi-purpose folding frame 100, second multi-purpose folding frame 100, third multi-purpose folding frame 100, and fourth multi-purpose folding frame 100 can be folded together. The folded multi-purpose folding frame module has a small size to facilitate storage and transportation. Each multi-purpose folding frame 100 has the advantages of the above multi-purpose folding frame. Such advantages are not further detailed.

Figure 12:
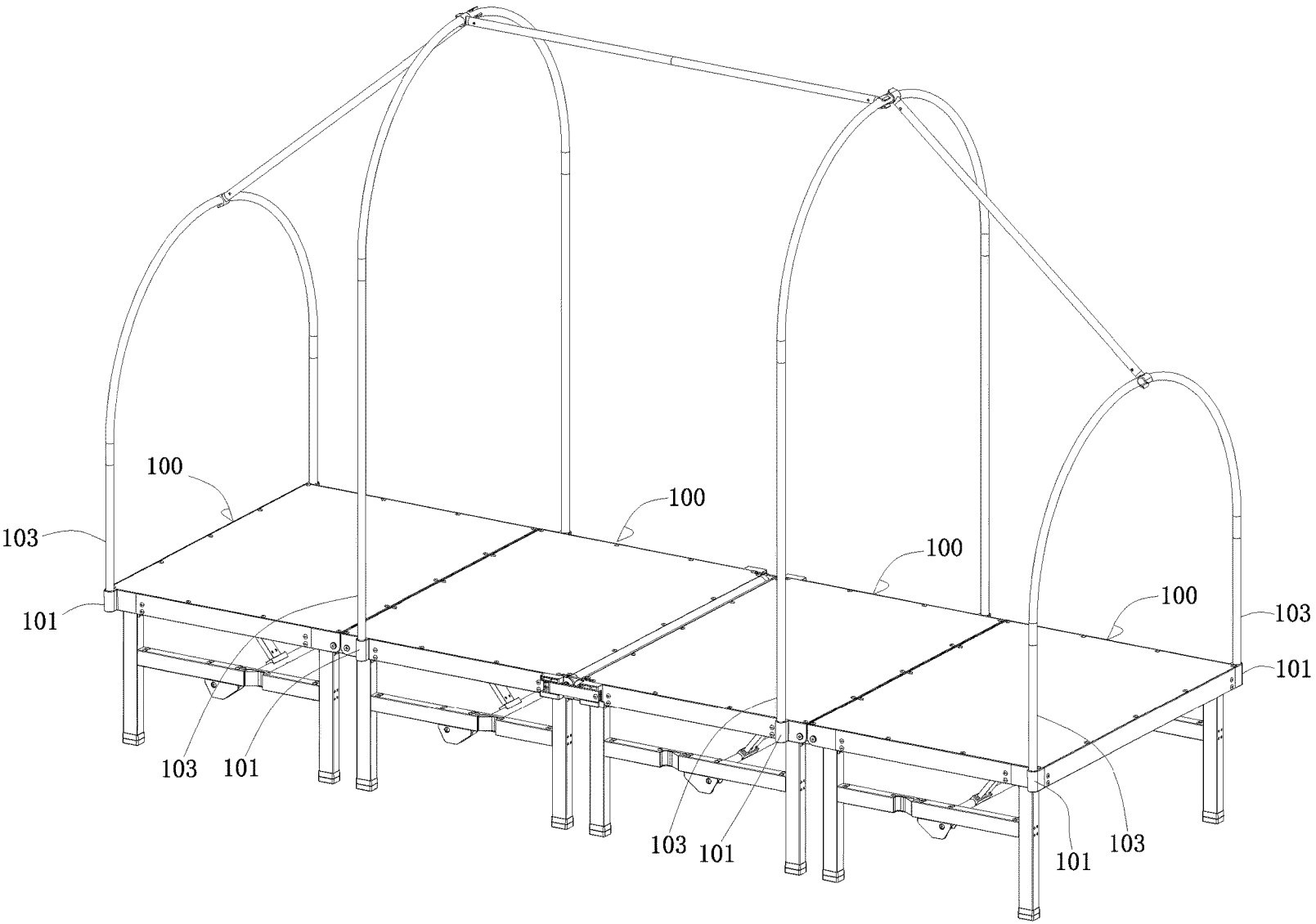
FIG. 12 is a perspective view of the multi-purpose folding frame module of the invention after installing the supporting tube.
Figure 13:
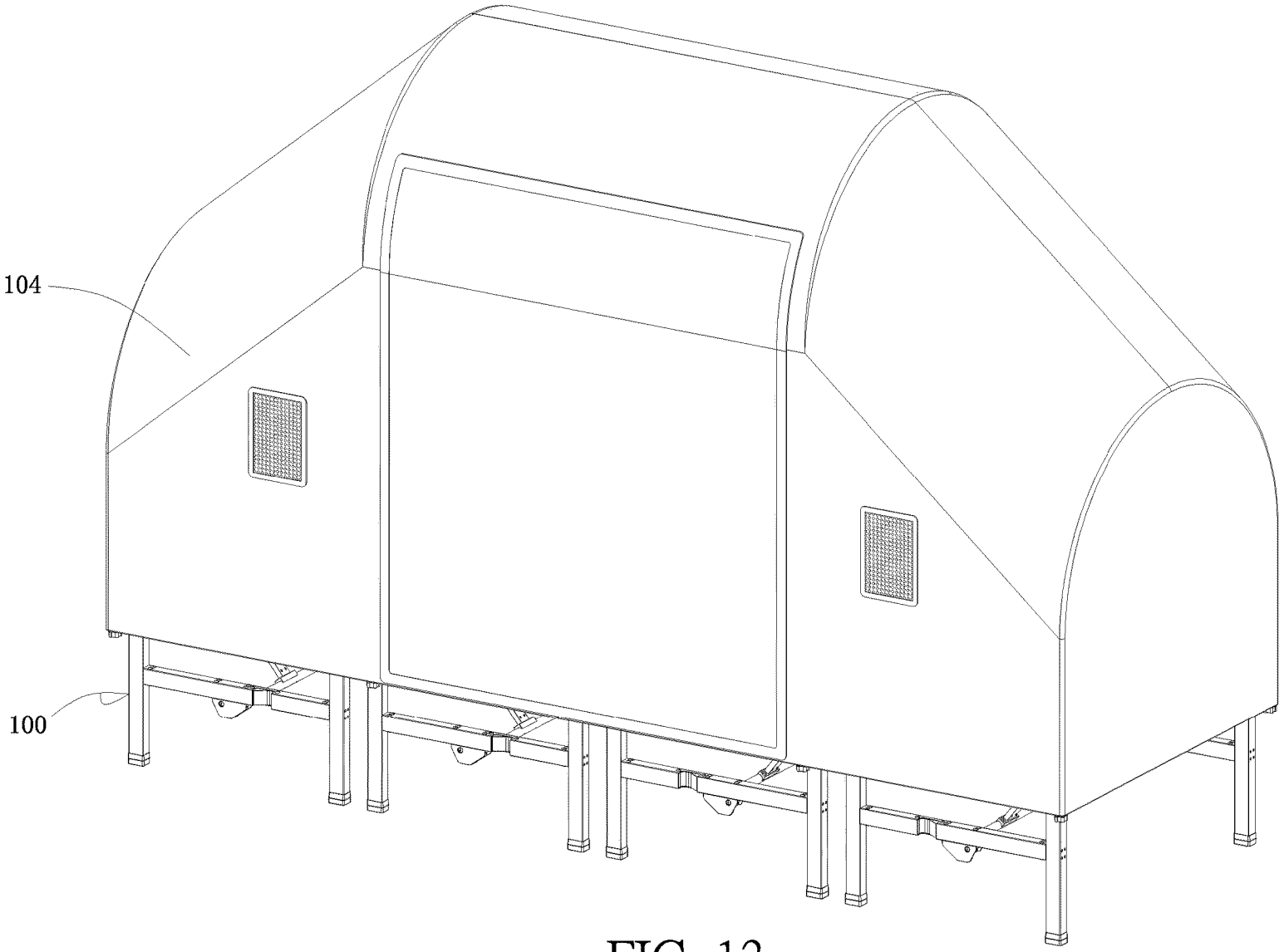
FIG. 13 is a perspective view of the multi-purpose folding frame module of the invention after installing the first tarpaulin.
Figure 14:
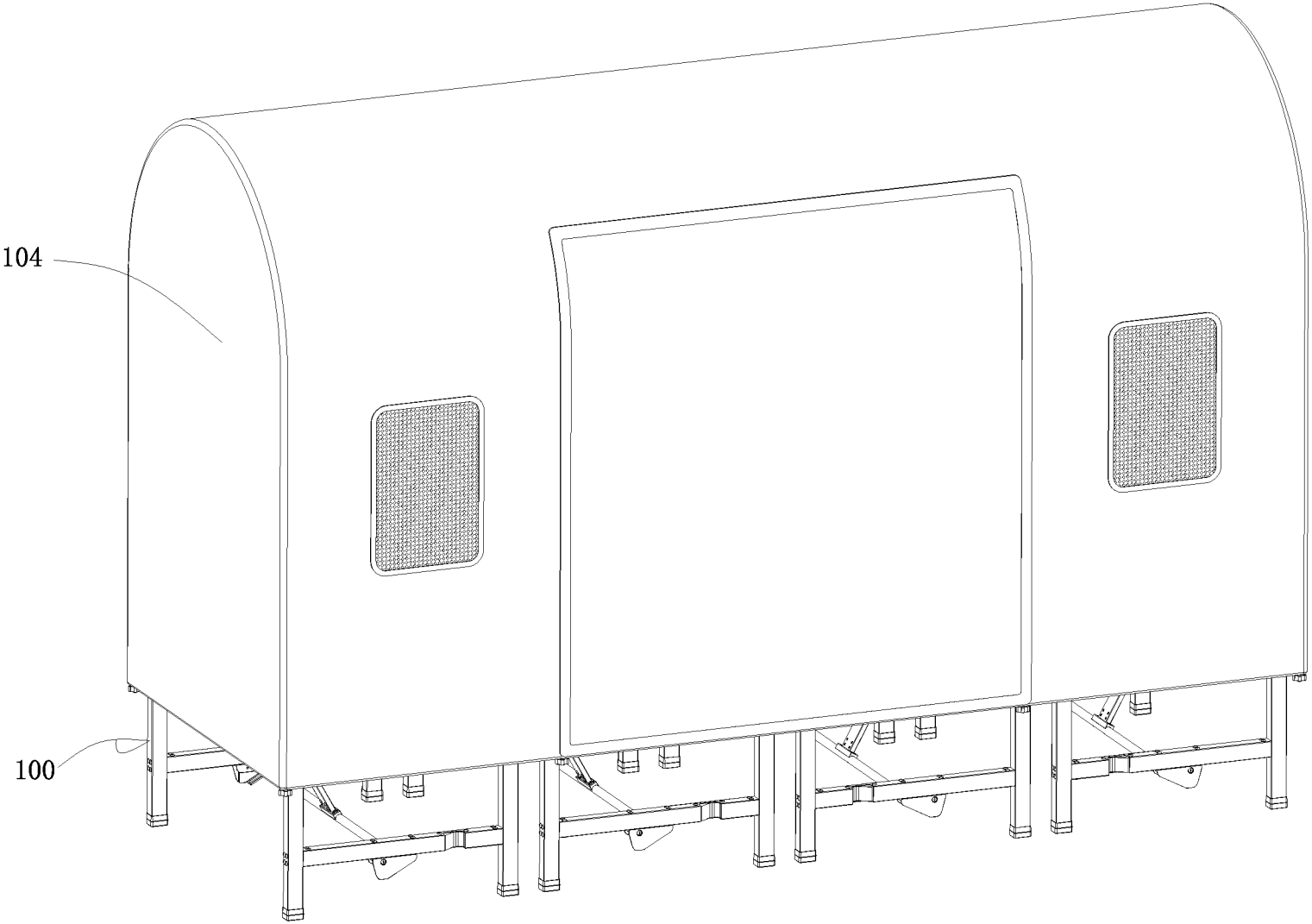
FIG. 14 is a perspective view of the multi-purpose folding frame module of the invention after installing the second tarpaulin.

Further referring to FIGS. 12-14, the periphery of each multi-purpose folding frame 100 is configured with an inserting seat 101. The inserting seat 101 has an inserting hole 102 (disclosed in FIG. 1 and FIG. 6) for the supporting tube 103 to insert. When the supporting tube 103 is inserted and fixed in the inserting hole 102, the upper end of the supporting tube 103 is formed with a supported structure. The supported structure can be attached with tarpaulins 104 of various shapes to form outdoor beds of various designs.

I claim:

1. A multi-purpose folding frame, comprising a surface board (1), two leg frames (2) installed on both ends of a bottom surface of the surface board (1) and used to support the surface board (1) and capable of being folded and stored relative to the surface board (1), and a collapsible support lock frame (3) disposed on a lower end surface of the surface board (1), wherein the support lock frame (3) includes a hinge rod (31) hinged to the lower end surface of the surface board (1) and a support lock bar (32) fixed at an end of the hinge rod (31); an inner side of each leg frame (2) includes a lock seat (21), and the lock seat (21) is provided with a lock groove (210); when the support lock frame (3) is opened relative to the panel (1), the end of the support lock bar (32) extends into and locks in the lock groove (210) of the lock seat (21), so that the two ends of the support lock bar (32) respectively support and lock the two leg frames (2).

2. The multi-purpose folding frame according to claim 1, wherein the lock seat (21) includes a holding slot (211) connected to the lock groove (210) at an entrance of the lock groove (210), the holding slot (211) is hinged with a freely rotatable stopping block (212), the stopping block (212) swings down under the action of gravity until a side of the blocking block (212) contacts an inner wall of the holding slot (211), and the stopping block (212) is blocked at the entrance of the lock groove (210) to prevent the end of the support lock bar (32) from breaking out of the lock groove (210); when the multi-purpose folding frame is overturned by 90°, the stopping block (212) swings downward under the action of gravity and is accommodated in the holding slot (211).

3. The multi-purpose folding frame according to claim 2, wherein the lock groove (210) has locking convex ribs (213); the end portion of the support lock bar (32) is configured with a limiting slot (321), the limiting slot (321) is sheathed around the locking convex rib (213), and is tightly fixed and assembled.

4. The multi-purpose folding frame according to claim 1, wherein the leg frame (2) and the bottom surface of the surface board (1) are hinged through a first hinge seat (11) and a first hinge pin (12), and the first hinge seat (11) is fixed on the bottom surface of the surface board (1), a first torsion spring is configured between the leg frame (2) and the first hinge seat (11); when the leg frame (2) is folded and stored in relation to the surface board (1), the first torsion spring provides elastic force to drive the leg frame (2) to be attached to the bottom surface of the surface board (1).

5. The multi-purpose folding frame according to claim 4, wherein the hinge rod (31) is hinged to the bottom of the surface board (1) through a second hinge seat (13) and a second hinge pin (14), and the second hinge seat (13) is fixed on the bottom surface of the surface board (1), a second torsion spring (311) is arranged between the hinge rod (31) and the second hinge seat (13); the leg frame (2) is also configured with a tilted storage groove (23); when the hinge rod (31) is folded and stored in relation to the surface board (1), the second torsion spring (311) provides elastic force to drive the hinge rod (31) to be attached to the bottom surface of the surface board (1), and the support lock bar (32) is inserted into the storage groove (23).

6. A multi-purpose folding frame module, comprising at least two multi-purpose folding frames (100) as defined in claim 1, wherein the first multi-purpose folding frame (100) and the second multi-purpose folding frame (100) can be folded upward or downward, and a locking structure is configured between the first multi-purpose folding frame (100) and the second multi-purpose folding frame (100); wherein, each multi-purpose folding frame (100) includes a surface board (1) and two leg frames (2) installed on both ends of the bottom surface of the surface board (1) and used to support the surface board (1) and can be folded and stored relation to the surface board (1), the lower end surface of the surface board (1) is further configured with a foldable support lock frame (3), a hinge rod (31) hinged with the support lock frame (3) and the lower end surface of the surface board (1), and a support lock bar (32) fixed at the end of the hinge rod (31);

the inside of each frame (2) is configured with a lock seat (21), and the lock seat (21) is configured with a lock groove (210); when the support lock frame (3) is opened relation to the surface board (1), the end of the support lock bar (32) extends into and locks in the lock groove (210) of the lock seat (21), so that the two ends of the support lock bar (32) support and lock the two leg frames (2) respectively.

7. The multi-purpose folding frame module according to claim 6, wherein the opposite surfaces of the first multi-purpose folding frame (100) and the second multi-purpose folding frame (100) are respectively configured with a third hinge seat (4) and a fourth hinge seat (5), the third hinge seat (4) and the fourth hinge seat (5) are hinged through a first hinge plate (40) combined with a first hinge shaft (41) and a second hinge shaft (51), wherein, one end of the first hinge plate (40) is hinged with the third hinge seat (4) through the first hinge shaft (41); the other end of the first hinge plate (40) is hinged with the fourth hinge seat (5) through the second hinge shaft (51); thus, the first multi-purpose folding frame (100) and the second multi-purpose folding frame (100) can be folded in relation to each other.

8. The multi-purpose folding frame module according to claim 7, wherein the locking structure comprises a locking board (61) and a locking plate (62) configured on the tip end of the locking board (61), and capable of free rotation, the locking board (61) is hinged on the front end of the third hinge seat (4), the locking board (61) can be rotated to be held inside the groove (52) on the front end of the fourth hinge seat (5), and under the force of its own gravity, the locking plate (62) swings downward and is embedded into the lock mouth (53) on the lower end of the groove (52), so that the tip end of the locking board (61) is locked inside the groove (52) of the front end of the fourth hinge seat (5).

9. The multi-purpose folding frame module according to claim 8, wherein the outer side of the locking plate (62) is further configured with a lug (621) to facilitate operation.

10. The multi-purpose folding frame module according to claim 6, wherein the outer side of the first multi-purpose folding frame (100) is further hinged with a third multi-purpose folding frame (100), the folding direction between the first multi-purpose folding frame (100) and the third multi-purpose folding frame (100) is opposite to the folding direction between the first multi-purpose folding frame (100) and the second multi-purpose folding frame (100); the outer side of the second multi-purpose folding frame (100) is further hinged with a fourth multi-purpose folding frame (100), the folding direction between the second multi-purpose folding frame (100) and the fourth multi-purpose folding frame (100) is opposite to the folding direction between the first multi-purpose folding frame (100) and the second multi-purpose folding frame (100), the first multi-purpose folding frame (100), the second multi-purpose folding frame (100), the third multi-purpose folding frame (100), and the fourth multi-purpose folding frame (100) can be folded together; each multi-purpose folding frame (100) is configured with an inserting seat (101), and the inserting seat (101) has an inserting hole (102) for the supporting tube (103) to insert in.

11. The multi-purpose folding frame module according to claim 6, wherein the lock seat (21) is configured with a holding slot (211) at the entrance of the lock groove (210), which is communicated with the lock groove (210), the holding slot (211) is hinged with a stopping block (212) that can rotate freely, under the force of its own gravity, the stopping block (212) swings downward to its lateral side to contact the inner wall of the holding slot (211), the stopping block (212) blocks the entrance of the lock groove (210) to prevent the end portion of support lock bar (32) from falling off the lock groove (210); when the multi-purpose folding frame is turned for 90°, under the force of its own gravity, the stopping block (212) swings downward and is held inside the holding slot (211).

12. The multi-purpose folding frame module according to claim 11, wherein the lock groove (210) has locking convex ribs (213); the end portion of the support lock bar (32) is configured with a limiting slot (321), the limiting slot (321) is sheathed around the locking convex ribs (213) and is tightly fixed and assembled.

13. The multi-purpose folding frame module according to claim 11, wherein the leg frame (2) and the bottom surface of the surface board (1) are hinged through a first hinge seat (11) combined with a first hinge pin (12), and the first hinge seat (11) is fixed on the bottom surface of the surface board (1), a first torsion spring is configured between the leg frame (2) and the first hinge seat (11); after the leg frame (2) is folded in relation to the surface board (1) for storage, the first torsion spring provides an elastic force for the leg frame (2) to be attached to the bottom surface of the surface board (1).

14. The multi-purpose folding frame module according to claim 13, wherein the hinge rod (31) and the bottom surface of the surface board (1) are hinged through a second hinge seat (13) combined with a second hinge pin (14), and the second hinge seat (13) is fixed on the bottom surface of the surface board (1), a second torsion spring (311) is configured between the hinge rod (31) and the second hinge seat (13); the leg frame (2) is configured with a tilted storage groove (23), after the hinge rod (31) is folded in relation to the surface board (1) for storage, the second torsion spring (311) provides an elastic force for the hinge rod (31) to be attached to the bottom surface of the surface board (1), and the support lock bar (32) is embedded into the storage groove (23).

* * * * *